US005088506A

United States Patent [19]

Kastner

[11] Patent Number: 5,088,506

[45] Date of Patent: Feb. 18, 1992

[54] PORTABLE MANUALLY OPERABLE CIGARETTE MAKING MACHINE

[76] Inventor: Arnold Kastner, 10220 Armand Lavergne, Montreal North, Quebec, Canada, H1H 3N5

[21] Appl. No.: 350,915

[22] Filed: May 12, 1989

[30] Foreign Application Priority Data

May 16, 1988 [CA] Canada ..... 566930

[51] Int. Cl.[5] ..... A24C 5/02; A24C 5/06

[52] U.S. Cl. ..... 131/70; 131/72; 131/75

[58] Field of Search ..... 131/70, 72, 75

[56] References Cited

U.S. PATENT DOCUMENTS 3,746,011 7/1973 Kappeler et al. ..... 131/72

FOREIGN PATENT DOCUMENTS 0526784 6/1956 Canada ..... 131/70

0725058 3/1955 United Kingdom ..... 131/70

*Primary Examiner*—V. Millin

*Attorney, Agent, or Firm*—McFadden, Fincham, Marcus & Anissimoff

[57] ABSTRACT

This invention relates to portable manually operable cigarette making machines, one problem is the number of moving parts any reduction of these parts reduces the cost of the machine and the wearing of these parts. These machines have two basic functions controlled by a single drive handle, the first controls compaction of tobacco, the second ejection of tobacco. The compaction function is improved by two alternative cam arrangements interacting with the compactor. In one embodiment, a stud moving in an internal cam raceway controls all cam motion, this greatly simplifies backward and forward motion of the compactor, preferably the stud is a roller stud. In the other embodiment, an internal cam cooperates with an internal cavity of the compactor. In both embodiments movement of the handle drive, first moves the compactor forward, then the compactor remains stationary, while further motion of the handle ejects the tobacco. This not only reduces moving parts hence complexity and wear, but also reduces tobacco dust infiltration, which tends to clog the machinery.

18 Claims, 8 Drawing Sheets

PORTABLE MANUALLY OPERABLE CIGARETTE MAKING MACHINE

This invention relates to cigarette making machines, particularly it relates to manually operable, portable, domestic cigarette making machines.

One type of cigarette machine is hand fed tobacco which is compacted into substantially cylindrical form in a tobacco receiving and compacting means, and the cylinder is then ejected into a cigarette tube. Such machines are usually have functional subsystems operated by a single manually operated handle or lever which moves in an arc. Initially the handle is at the start of the arc, the tobacco is dropped into the receiving and compacting means, the handle is turned actuating compacting means until the tobacco has been compacted into a substantially cylindrical form, when the tobacco compacting means has ceased compacting, further motion of the handle along the arc actuates a plunger or piston arrangement which ejects the compacted tobacco into a cigarette tube, while at the same time retaining the tobacco compacting means in its final position, at the end of the arc of travel the plunger has travelled to the beginning of the cigarette tube. Often means to hold the cigarette tube in position are supplied actuated at the beginning of the handle arc, the holding means can be operated by the compactor means, the plunger means, or independently.

DESCRIPTION OF RELATED ART

Traditionally the handle rotates about a fixed axis controlling the tobacco compacting means and the plunger means independently, the tube holding means is usually controlled by either of the compactor means or the plunger means. It has been desirable to reduce the number of moving parts to simplify manufacture, to reduce manufacturing costs and to reduce wear of components.

Cdn.P. 510,615, issued Mar. 8, 1955, to K. Kastner, teaches a cigarette machine, where motion of the compactor is controlled by a cam mounted on a shaft rotatably controlled by a hand lever, this cam interacts with two rollers mounted on an arm, thus moving the arm and thus the compactor radially of the shaft. The plunger is mounted on another arm which is controlled by studs mounted on the cam, which enable the second arm to be moved circumferentially of the shaft. A spring generally urges a cigarette retaining pin into position, except at the beginning of compressive motion of the compactor, and the end of ejective motion of the plunger, where spring is opposed and the cigarette retaining pin is not in position. Cdn. P. 651,583, issued Nov. 6, 1962, to Seitter, teaches a similar machine, the basic differences are that the compactor is urged to noncompacting position by paired springs, and the compactor is driven to compact by a cam mounted on the shaft in contact with the non compacting side of the compactor, the handle itself is used to move the plunger by interaction of a plunger mounted stud with a cam slot in the handle. The cigarette tube retaining means is mounted on the compactor and engages the tube as long as the compactor is in compacting position. U.S. Pat. No. 3,127,900, issued Apr. 7, 1964, to A. Kastner, teaches a variation on the machine, in this case he means to hold the cigarette tube are variable in release position, the basic structure while different from the preceding examples, are similar in that the compacting means is controlled by a cam arrangement in this case through pivoted links, while the plunger is controlled by an arm interacting with studs on the cam, through a pivoted link. Cdn. p. 1,039,603, issued Oct. 3, 1978, to Moscovitch, teaches a machine where the compactor and plunger are controlled by separate handles, the compactor is connected by a pivoted link to a crank lever. In these machines the compactor is a block usually of metal having a concave hemicylindrical face sliding on a support plate between two walls or guide ribs, which cooperates with a stationary concave hemicylindrical face to form a cylindrical cavity containing the compacted tobacco.

BACKGROUND OF THE INVENTION

In one broadest aspect the invention is directed to a machine for compacting a batch of tobacco into a generally cylindrical body, then injecting the cylindrical body into a tube to form a cigarette, comprising a frame; a first and movable second compacting member the members having faces defining between themselves a tobacco receiving chamber having first and second ends, the second member normally spaced apart from the first member; a shaft turnably mounted in the frame forming a fixed pivot axis; an actuating member turnable about the axis in an arcuate path between a first position, through a second position to a third position; cam means turnable about the fixed pivot axis by the actuating member, the cam means having an internal raceway entraining stud means mounted on the second member and urging the second member toward the first member when the actuating member moves from the first position toward the second position, whereby the volume of the chamber is reduced and a batch of tobacco contained in the chamber is compacted by the faces into a substantially cylindrical body; the cam means, internal raceway, and stud means combining to urge the second member away from the first member when the actuating member moves from the second position toward the first position; tube supporting means aligned with and communicating with one end of the chamber; and means for expelling the compacted body from the chamber comprising a plunger located at the other end of the chamber and motion transmitting means connected to the plunger, so that when the actuating means moves from the second position toward the third position, the plunger is moved through the chamber expelling the body through the tube supporting means into a tube mounted on the supporting means. In preferred form, the motion transmitting means comprises abutment means secured to the actuating member, an arm turnable about the shaft pivotally connected to the plunger; the abutment means contacting the arm when the actuating means is in the second position, so that when the actuating means moves from the second position toward the third position, the plunger is moved through the chamber. More preferably the first and movable second compacting members have concave faces defining between them the tobacco receiving chamber, the stud means is roller stud means engaging the raceway on both sides; the tube supporting means being a tube supporting nipple: the configuration of the raceway being such that the volume of the chamber remains unchanged as the actuating member moves from the second position to the third position, while the plunger expels the body of tobacco from the chamber. The arm may be pivotally linked to a connecting link, which is pivotally linked to the plunger. This plunger may comprise an elongated extension projecting into the chamber adjacent the first member, when the plunger is located at the other end of the chamber, this extension is movable through the nipple and into the tube to facilitate the introduction of the body of tobacco into the tube. Tube retaining means may be provided, comprising a tube retaining lever slidably mounted on the frame, a spring mounted on the frame urging the tube retaining lever into tube retaining position against the tube supporting means, means on the tube retaining lever engaging means on the second member, whereby the tube retaining lever is in tube releasing position when the compacting members are spaced apart. The cam can be integral with the actuating means, and the abutment means may be mounted on the cam. Spring means may be mounted on the frame and connected to the arm urging the arm into a position whereby the plunger is at the other end of the chamber.

In another aspect the invention is directed to an improvement in a machine for compacting a batch of tobacco into generally cylindrical body, then injecting the cylindrical body into a tube to form a cigarette, comprising first and movable second compacting member the members having faces defining between themselves a tobacco receiving chamber having first and second ends, the second member normally spaced apart from the first member; and cam means turnable about fixed pivot axis means by actuating member means, the improvement comprising the cam means having an internal raceway entraining stud means mounted on the second member and urging the second member toward the first member when the actuating member moves from a first position toward a second position, whereby the volume of the chamber is reduced and a batch of tobacco contained in the chamber is compacted by the faces into a substantially cylindrical body; the cam means, internal raceway and stud means combining to urge the second member away from the first member when the actuating member moves from the second position toward the first position. Preferably the stud means is roller stud means engaging the raceway on both sides, the configuration of the raceway being such that the volume of the chamber remains unchanged as the actuating member moves beyond the second position to a third position. The advantage of the internal raceway arrangement is that the pressure in forward compactor motion is exerted by the internal edge of the raceway, while the pressure in backward compactor motion is exerted by the external edge of the raceway, thus evening wear.

In another broadest aspect the invention is directed to a machine for compacting a batch of tobacco into generally cylindrical body, then injecting the cylindrical body into a tube to form a cigarette, comprising a frame; a first and movable second compacting member the members having faces defining between themselves a tobacco receiving chamber having first and second ends, the second member normally spaced apart from the first member; a shaft turnably mounted in the frame forming a fixed pivot axis; an actuating member turnable about the axis in an arcuate path between a first position, through a second position to a third position; cam means turnable about the fixed pivot axis by the actuating member, the cam means being internal of a cavity of the second member, the cavity having walls, the cam means being adapted to be in cooperating contact with the walls, the contact urging the second member toward the first member when the actuating member moves from the first position toward the second position, whereby the volume of the chamber is reduced and a batch of tobacco contained in the chamber is compacted by the faces into a substantially cylindrical body; the contact urging the second member away from the first member when the actuating member moves from the second position toward the first position; tube supporting means aligned with and communicating with one end of the chamber; and means for expelling the compacted body from the chamber comprising a plunger located at the other end of the chamber and motion transmitting means connected to the plunger, so that when the actuating means moves from the second position toward the third position, the plunger is moved through the chamber expelling the body through the tube supporting means into a tube mounted on the supporting means. In general preferred variations of this embodiments are equivalent to those of the previous embodiment as the difference resides in the compactor block motion transmitting means.

In another aspect the invention is directed to an improvement in a machine for compacting a batch of tobacco into generally cylindrical body, then injecting the cylindrical body into a tube to form a cigarette, comprising first and movable second compacting member the members having faces defining between themselves a tobacco receiving chamber having first and second ends, the second member normally spaced apart from the first member; and cam means turnable about fixed pivot axis means by actuating member means, the improvement comprising the cam means being internal of a cavity of the second member, the cavity having walls, the cam means being adapted to be in cooperating contact with the walls, the contact urging the second member toward the first member when the actuating member moves from the first position toward the second position, whereby the volume of the chamber is reduced and a batch of tobacco contained in the chamber is compacted by the faces into a substantially cylindrical body; the contact urging the second member away from the first member when the actuating member moves from the second position toward the first position. Preferably the cam means and cavity have a configuration such that the volume of the chamber remains unchanged as the actuating member moves beyond the second position to a third position.

The advantage of the internal cam in the internal cavity is that again the wear is reduced because the forward motion pressure exerting areas are different fron the backward pressure exerting areas, and also that tobacco dust infiltration into the compactor cavity is greatly reduced thus not only reducing wear caused by tobacco dust, but also clogging of parts.

The parts of the machine may be all metal or plastic of suitable properties may be substituted for many parts of the machine. Especially the casing, the compactor block, and parts of the plunger can be manufactured of suitable plastic.

BRIEF DESCRIPTION OF THE DRAWINGS

Preferred embodiments are indicated in the drawings where:

The machine is generally indicated in FIG. 1, by the numeral 10, and has a base plate 12, a casing 14, a cigarette tube nipple 16, a tobacco slot 18, a handle 20, and a handle drive 22. A bottom view of the machine with handle drive 22, in the starting position is shown in FIG. 2, the drive handle 22 is integral with cam 24, cam 24 is mounted on shaft 26 which is rotatable with respect to base plate 12, cam 24 includes internal raceway 28 in which controls motion of roller stud 30 mounted on compactor 32, which slides back and forth on lower casing 34, between guides 36 and 38. Rotating handle drive 22 in an anticlockwise direction as viewed from below from the position of FIG. 2 to the position of FIG. 3, urges the compactor forward to its furthest forward compacting the tobacco, as roller stud 80 moves along raceway 28. At the same time the forward motion of compactor 32, allows cigarette tube retainer 40 to be urged forward to contact cigarette tube nipple 16 by spring 42 acting against fixed stop 44, when the compactor is in the back position, cigarette tube retainer is held back by projection 46 engaging recess 48 of compactor 32. As the handle drive 22 reaches the position shown in FIG. 3, the compactor has reached its forward point where it effectively remains for the rest of the motion of the handle drive 22. Continuation of the movement allows stud 50 to engage lever 52 urging it anticlockwise against the pressure of retaining spring 54 attached to support plate 56, lever 52 brings connecting link 58 with it pivoting between pivots 57, and 59 moving tobacco plunger and spoon 60 towards and through the cigarette tube nipple 16, ejecting the tobacco (not shown) into the cigarette tube (not shown), the final position is shown in FIG. 5. A cavity 62 in this case square is present in compactor 32, to allow the compactor to move around shaft 26. On releasing the handle drive 22, the spring 54 contracts rotating the cam 26 in a clockwise direction, returning the machine to the position shown in FIG. 2, stud 51 may engage the lever 52 at the end of he return travel, preventing further motion. As shown in FIG. 5, shaft 26 is surrounded by spacing and guide block 68, which may be plastic, at the lower end it is threaded into nut 64 which rests in bushing 66 provided in base 12. Shaft nut and bushing are preferably metal, more preferably brass, at the upper end it is threaded into casing 14, preferably made of plastic.

The second embodiment basically differs from the first in having a cam internal of the compactor block. FIG. 6 shows the compactor at the beginning of motion with cavity 64 shown in compactor 32. FIG. 7 shows the compactor at the end of its forward motion indicating the cavity 64. FIG. 8 shows the compactor at the end of its forward motion and the plunger fully extended indicating the cavity 64. The cam action itself is shown in FIGS. 9 to 11. All features except those relating to the compactor cam drive are identical in both embodiments, and these details are not redescribed in order to avoid repetition.

FIG. 9 shows the cam/compactor block position at the beginning of compression (corresponding to FIG. 6), cam 66 mounted on shaft 26, is in cavity 64 of compactor block 32, cam and cavity wall have contact areas 68, 69 as handle drive 22 is moved anticlockwise contact 69 exerts pressure on compactor block 32 in a forward direction, similarly clockwise motion of drive 22 exerts pressure in a backward direction through contact 68. FIG. 10 shows the cam/compactor block at the end of compression but before plunger extension (corresponding to FIG. 7), contact area 70 exerts no pressure forward or backward and thus drive 22 can be rotated anticlockwise without moving the compactor block. Finally FIG. 11 shows the cam/compactor block at the end of compression after plunger extension (corresponding to FIG. 8), contact area 71 exerts no pressure forward or backward with motion of drive 22.

Figure 1:
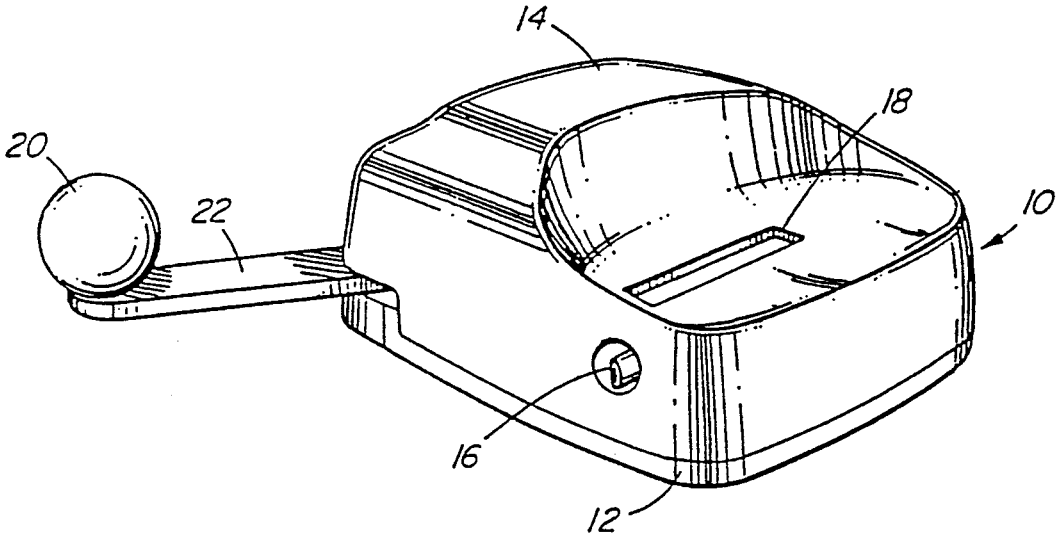
FIG. 1 illustrates the external appearance of a preferred embodiment of the invention.
Figure 2:
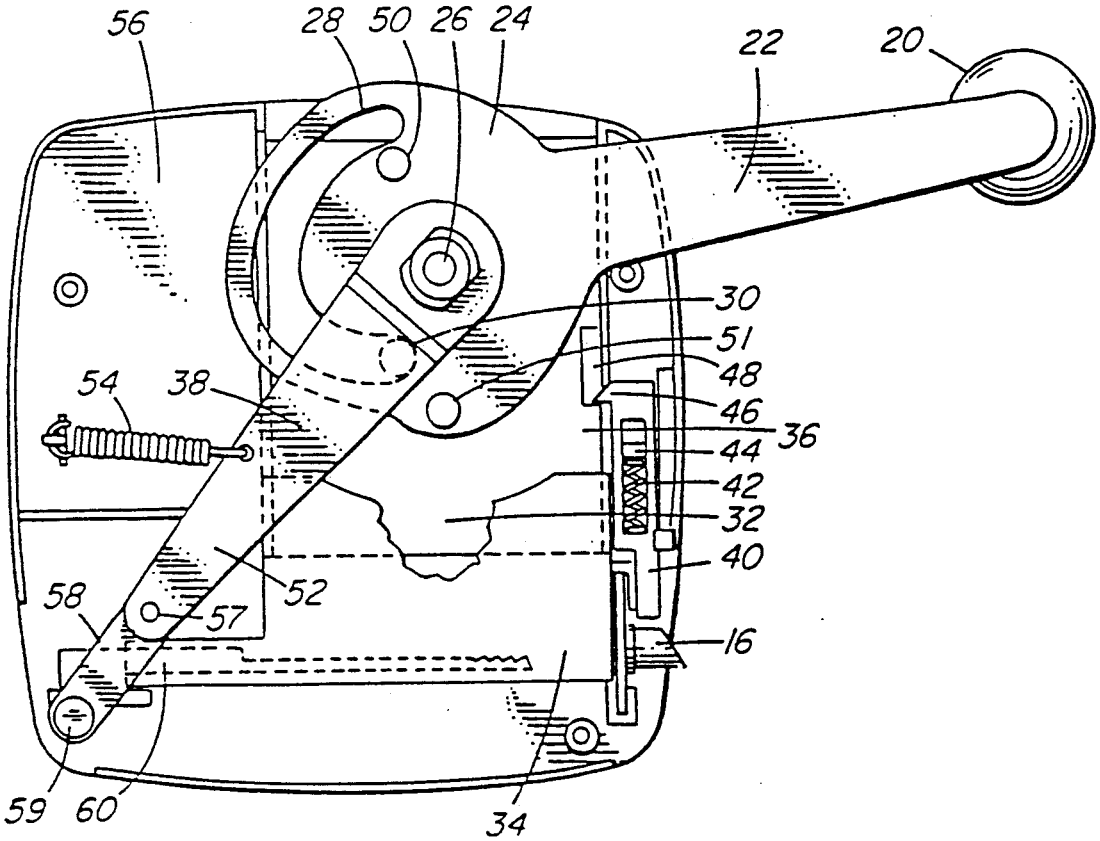
FIG. 2 shows a bottom view of this embodiment at the point of addition of the tobacco to be compacted.
Figure 3:
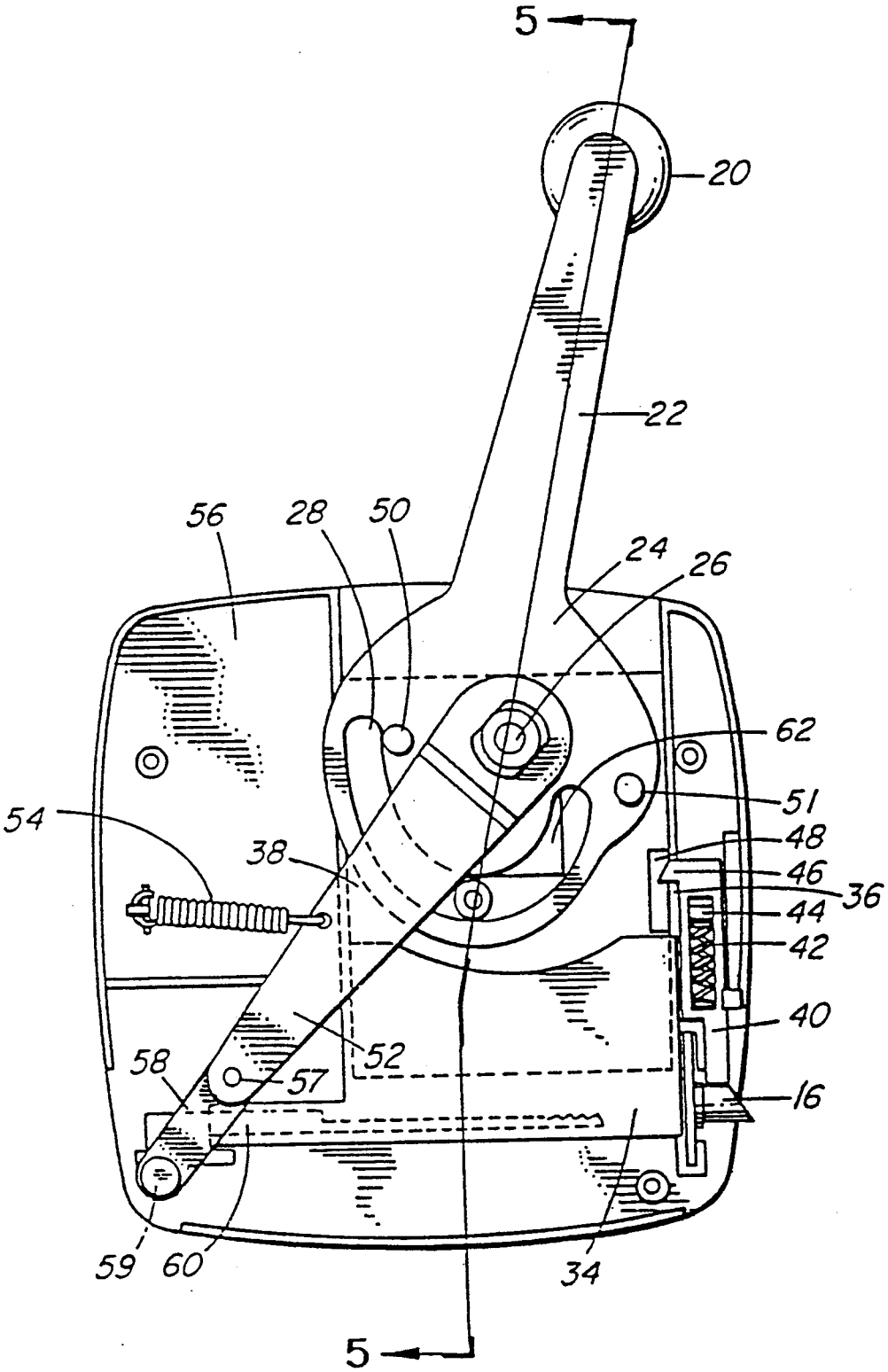
FIG. 3 shows a bottom view of this embodiment at the beginning of motion of the plunger.
Figure 4:
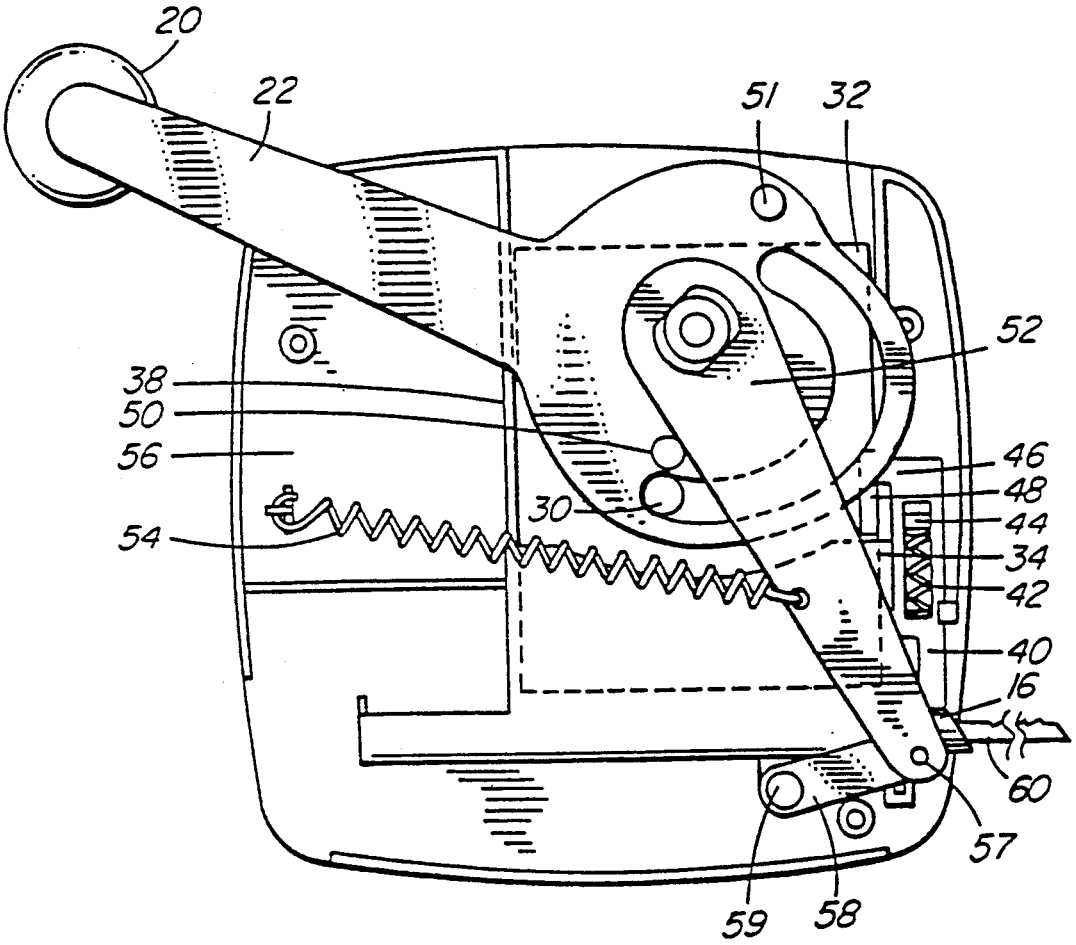
FIG. 4 shows a bottom view of this embodiment at the end of motion of the plunger.
Figure 5:
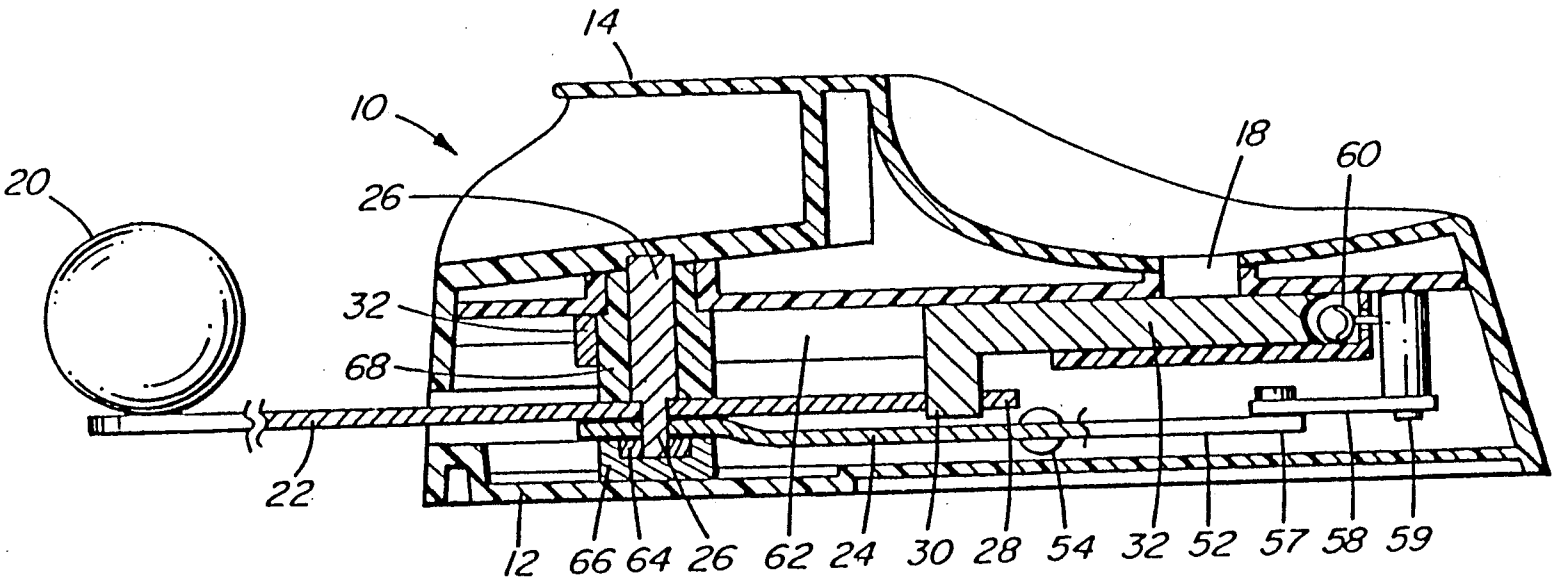
FIG. 5 shows a cross section of this embodiment at the beginning of motion of the plunger.
Figure 6:
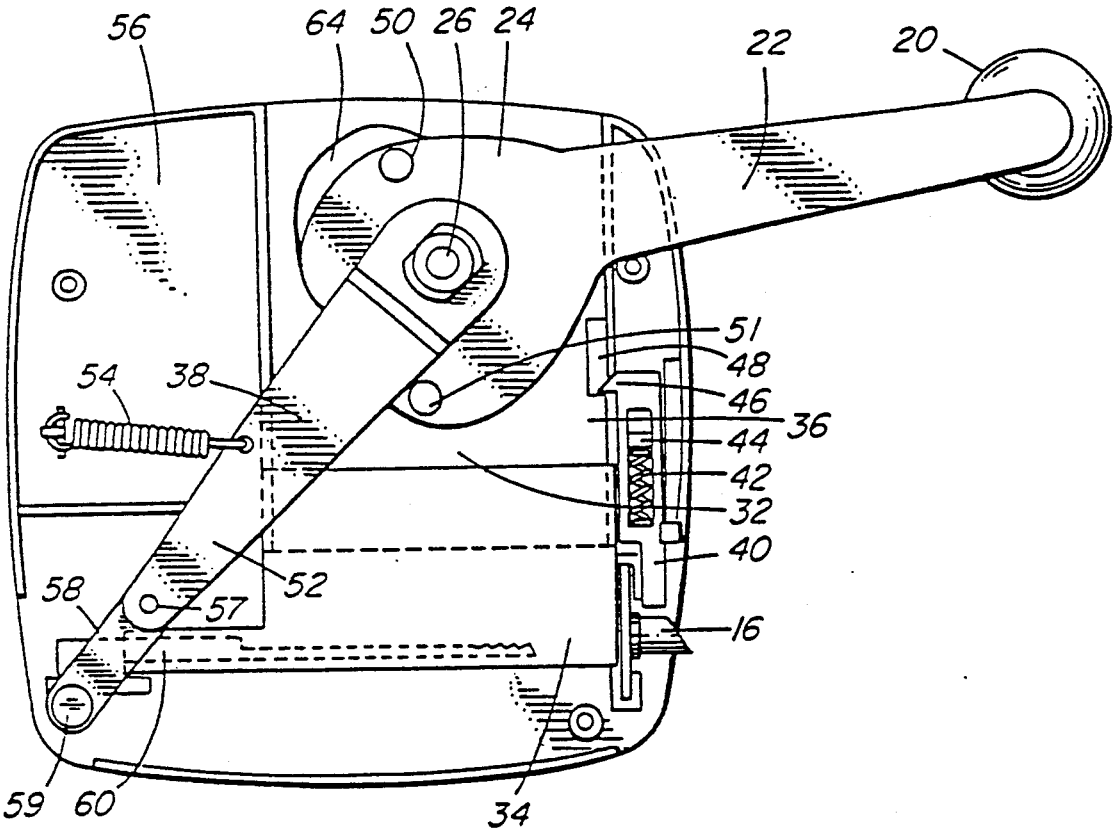
FIG. 6 shows a bottom view of an alternative preferred embodiment of the invention at the moment of addition of the tobacco.
Figure 7:
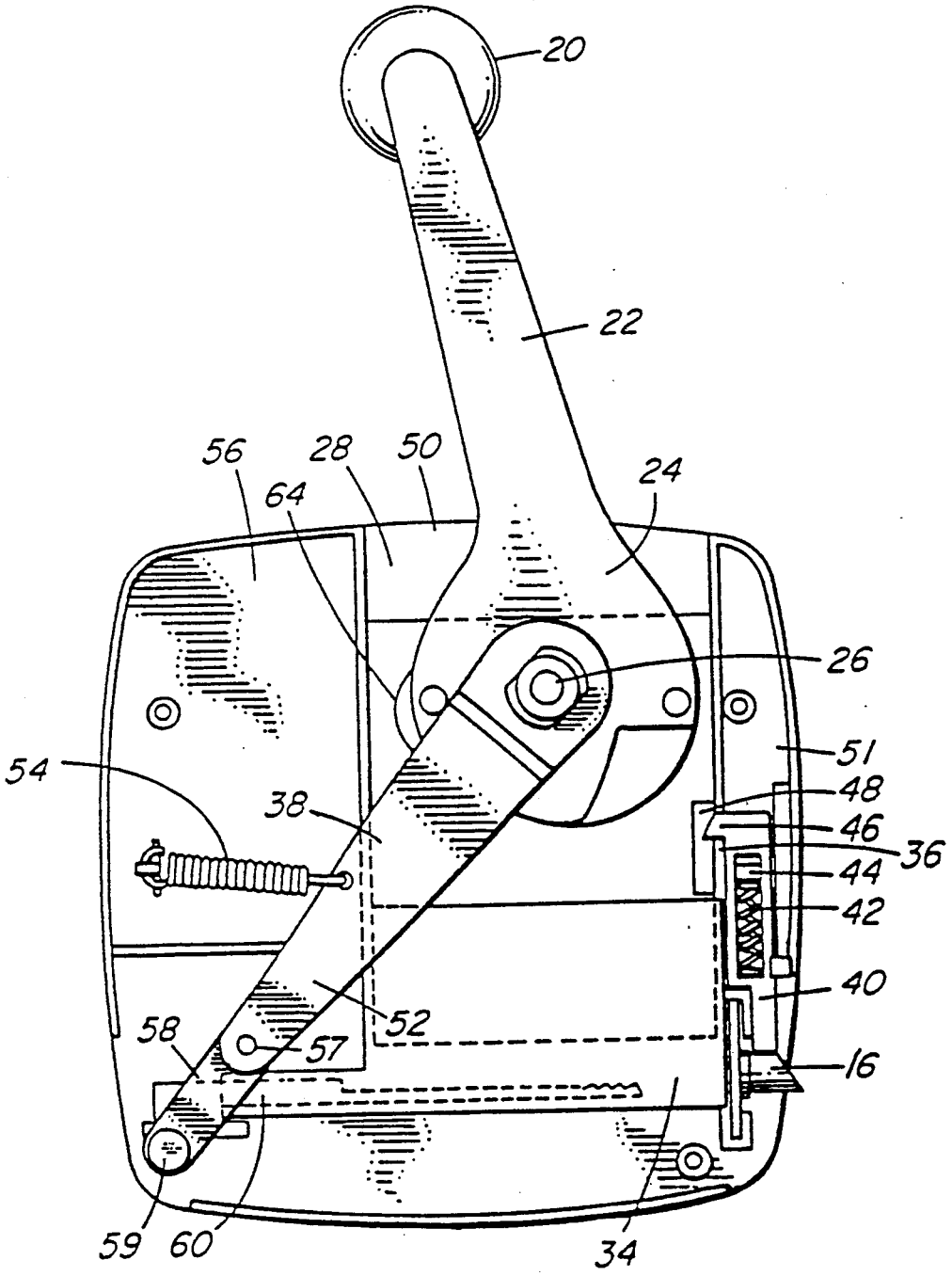
FIG. 7 shows a bottom view of this embodiment at the beginning of motion of the plunger.
Figure 8:
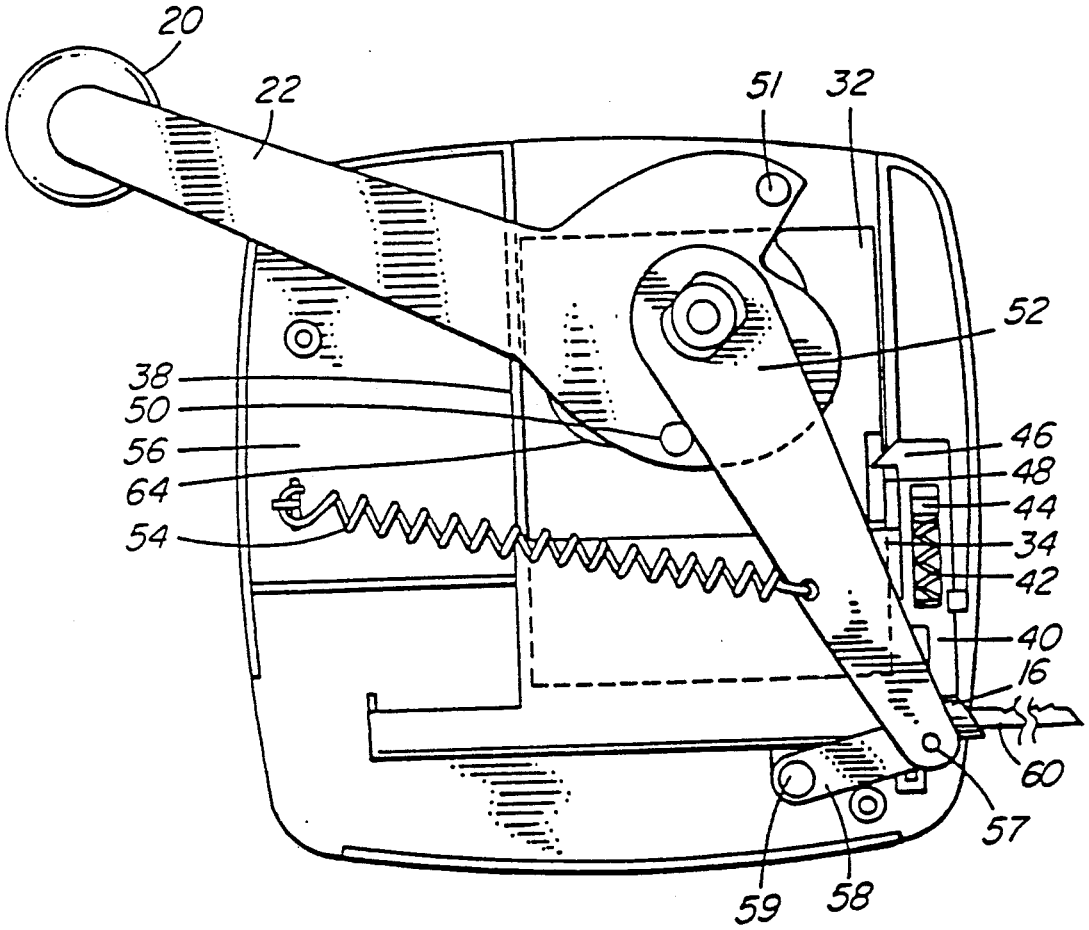
FIG. 8 shows a bottom view of this embodiment at the end of motion of the plunger.
Figure 9:
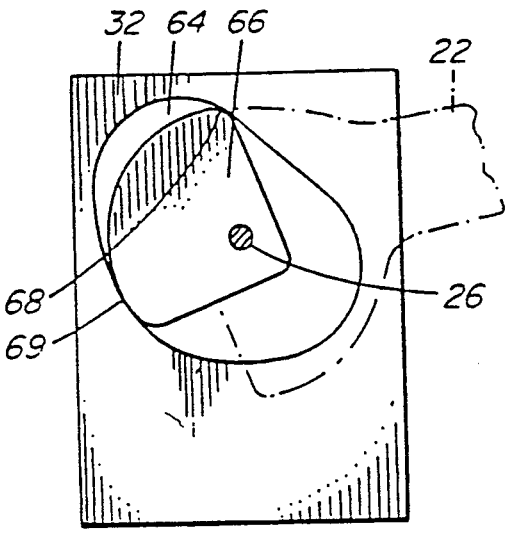
FIGS. 9, 10, and 11 shows the cooperation of the compactor block with its internal cam corresponding to FIGS. 6, 7, 8.
Figure 10:
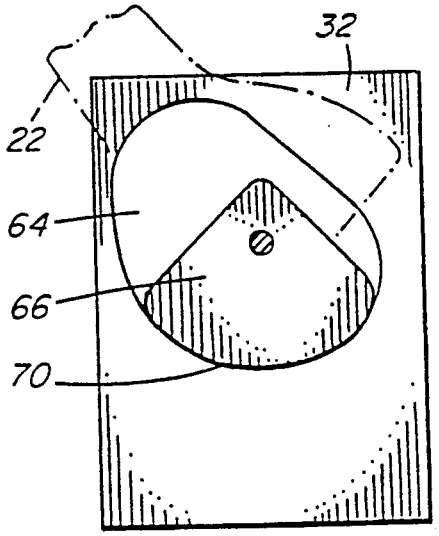
Figure 11:
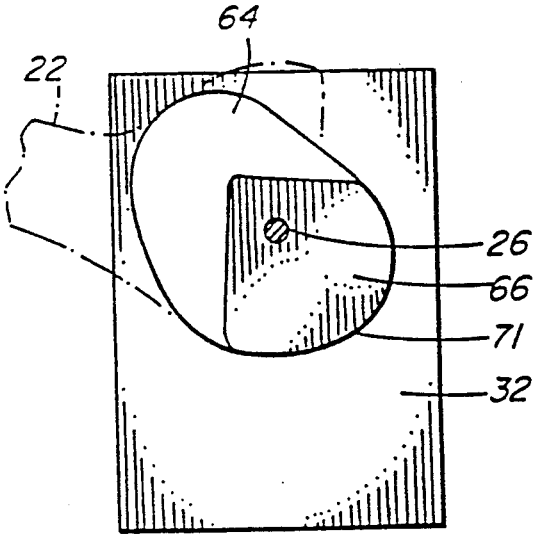

Although this invention is described in terms of specific embodiments, it is not limited thereto, as would be understood by those skilled in the art, numerous variations are possible within the range of the invention, without departing from the spirit and nature thereof.

I claim:

1. A machine for compacting a batch of tobacco into a generally cylindrical body, then injecting said cylindrical body into a tube to form a cigarette, comprising a frame; a first compacting member and a movable second compacting member, said members having faces defining between themselves a tobacco receiving chamber having first and second ends, said second movable member normally spaced apart from said first member; a shaft turnably mounted in said frame forming a fixed pivot axis; an actuating member turnable about said axis in an arcuate path between a first position, through a second position to a third position; cam means turnable about said fixed pivot axis by said actuating member, said cam means having an internal raceway, and stud means on said second member, engaged by said internal raceway, said cam means acting directly on said second member and urging said second member toward said first member when said actuating member moves from said first position toward said second position, whereby the volume of said chamber is reduced and a batch of tobacco contained in said chamber is compacted by said faces into a substantially cylindrical body; said cam means, internal raceway, and stud means combining to urge said second member away from said first member when said actuating member moves from said second position toward said first position; tube supporting means aligned with and communicating with one end of said chamber; and means for expelling said compacted body from said chamber comprising a plunger located at the other end of said chamber and motion transmitting means connected to said plunger, so that when said actuating means moves from said second position toward said third position, said plunger is moved through said chamber expelling the body through said tube supporting means into a tube mounted on said supporting means.

2. The machine of claim 1, wherein said motion transmitting means comprises abutment means secured to said actuating member, an arm turnable about said shaft pivotally connected to said plunger; said abutment means contacting said arm when said actuating means is in said second position, so that when said actuating means moves from said second position toward said third position, said plunger is moved through said chamber.

3. The machine of claim 2, wherein said first compacting member and said movable second compacting member have concave faces defining between them said tobacco receiving chamber, said tube supporting means being a tube supporting nipple; the configuration of said cam means being such that the volume of said chamber remains unchanged as the actuating member moves from said second position to said third position, while said plunger expels said body of tobacco from said chamber.

4. The machine of claim 3, wherein said cam is integral with said actuating means, and said abutment means is mounted on said cam.

5. The machine of claim 4, additionally comprising spring means mounted on said frame and connected to said arm urging said arm into a position whereby said plunger is at the other end of said chamber.

6. The machine of claim 3, wherein said arm is pivotally linked to a connecting link, which is pivotally linked to said plunger.

7. The machine of claim 6, wherein said plunger comprises an elongated extension projecting into said chamber adjacent said first member when said plunger is located at the other end of said chamber, said extension is movable through said nipple and into said tube to facilitate the introduction of said body of tobacco into said tube.

8. The machine of claim 1, additionally including tube retaining means comprising a tube retaining lever slidably mounted on said frame, a spring mounted on said frame urging said tube retaining lever into tube retaining position against said tube supporting means, means on said tube retaining lever engaging means on said second member, whereby said tube retaining lever is in tube releasing position when said compacting members are spaced apart.

9. The machine of claim 1, wherein said stud means is roller stud means engaging said raceway on both sides, the configuration of said raceway being such that the volume of said chamber remains unchanged as the actuating member moves beyond said second position to a third position.

10. A machine for compacting a batch of tobacco into generally cylindrical body, then injecting said cylindrical body into a tube to form a cigarette, comprising a frame; a first compacting member and a movable second compacting member said members having faces defining between themselves a tobacco receiving chamber having first and second ends, said second member normally spaced apart from said first member; a shaft turnably mounted in said frame forming a fixed pivot axis; an actuating member turnable about said axis in an arcuate path between a first position, through a second position to a third position; cam means turnable about said fixed pivot axis by said actuating member, said cam means being internal of a cavity of said second member, said cavity having walls, said cam means being adapted to be in cooperating contact with said walls, said contact urging said second member toward said first member when said actuating member moves from said first position toward said second position, whereby the volume of said chamber is reduced and a batch of tobacco contained in said chamber is compacted by said faces into a substantially cylindrical body; said contact urging said second member away from said first member when said actuating member moves from said second position toward said first position; tube supporting means aligned with and communicating with one end of said chamber; and means for expelling said compacted body from said chamber comprising a plunger located at the other end of said chamber and motion transmitting means connected to said plunger, so that when said actuating means moves from said second position toward said third position, said plunger is moved through said chamber expelling the body through said tube supporting means into a tube mounted on said supporting means.

11. The machine of claim 10, wherein said motion transmitting means comprises abutment means secured to said actuating member, an arm turnable about said shaft pivotally connected to said plunger; said abutment means contacting said arm when said actuating means is in said second position, so that when said actuating means moves from said second position toward said third position, said plunger is moved through said chamber.

12. The machine of claim 11, wherein said first and movable second compacting members have concave faces defining between them said tobacco receiving chamber; said tube supporting means being a tube supporting nipple; the configuration of said cam and cavity being such that the volume of said chamber remains unchanged as the actuating member moves from said second position to said third position, while said plunger expels said body of tobacco from said chamber.

13. The machine of claim 12, wherein said arm is pivotally linked to a connecting link, which is pivotally linked to said plunger.

14. The machine of claim 13, wherein said plunger comprises an elongated extension projecting into said chamber adjacent said first member when said plunger is located at the other end of said chamber, said extension is movable through said nipple and into said tube to facilitate the introduction of said body of tobacco into said tube.

15. The machine of claim 10, additionally including tube retaining means comprising a tube retaining lever slidably mounted on said frame, a spring mounted on said frame urging said tube retaining lever into tube retaining position against said tube supporting means, means on said tube retaining lever engaging means on said second member, whereby said tube retaining lever is in tube releasing position when said compacting members are spaced apart.

16. The machine of claim 15, additionally comprising spring means mounted on said frame and connected to said arm urging said arm into a position whereby said plunger is at the other end of said chamber.

17. In a machine for compacting a batch of tobacco into generally cylindrical body, then injecting said cylindrical body into a tube to form a cigarette, comprising a first compacting member and a movable second compacting member said members having faces defining between themselves a tobacco receiving chamber having first and second ends, said second member normally spaced apart from said first member; and cam means turnable about fixed pivot axis means by actuating member means, the improvement comprising said cam means being internal of a cavity of said second member, said cavity having walls, said cam means being adapted to be in cooperating contact with said walls, said contact urging said second member toward said first member when said actuating member moves from said first position toward said second position, whereby the volume of said chamber is reduced and a batch of tobacco contained in said chamber is compacted by said faces into a substantially cylindrical body; said contact urging said second member away from said first member when said actuating member moves from said second position toward said first position.

18. The machine of claim 17, wherein cam means and cavity have a configuration such that the volume of said chamber remains unchanged as the actuating member moves beyond said second position to a third position.

* * * * *